US011199070B2

(12) United States Patent
Koli

(10) Patent No.: US 11,199,070 B2
(45) Date of Patent: Dec. 14, 2021

(54) SCREEN AND VALVE SYSTEM

(71) Applicant: Jai Kishan Koli, Alberta (CA)

(72) Inventor: Jai Kishan Koli, Alberta (CA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 62 days.

(21) Appl. No.: 16/784,465

(22) Filed: Feb. 7, 2020

(65) Prior Publication Data

US 2021/0246760 A1 Aug. 12, 2021

(51) Int. Cl.
*E21B 34/06* (2006.01)
*E21B 43/08* (2006.01)

(52) U.S. Cl.
CPC ..... *E21B 34/06* (2013.01); *E21B 43/08* (2013.01); *E21B 2200/06* (2020.05)

(58) Field of Classification Search
CPC ..... E21B 34/06; E21B 34/14; E21B 34/142; E21B 43/08; E21B 2200/06; E21B 33/00; E21B 23/04
See application file for complete search history.

(56) References Cited

U.S. PATENT DOCUMENTS

| | | | | |
|---|---|---|---|---|
| 5,810,084 | A * | 9/1998 | Echols | E21B 17/06 166/242.7 |
| 8,225,863 | B2 | 7/2012 | Hammer et al. | |
| 2011/0024105 | A1* | 2/2011 | Hammer | E21B 43/08 166/113 |
| 2018/0128082 | A1* | 5/2018 | Hollan | E21B 34/10 |

* cited by examiner

*Primary Examiner* — George S Gray
(74) *Attorney, Agent, or Firm* — Cantor Colburn LLP

(57) ABSTRACT

A screen and valve system includes a first screen portion including an inner surface and an outer surface. The inner surface defines a first conduit section. A second screen portion includes an inner surface portion and an outer surface portion. The inner surface portion defines a second conduit section. The second screen portion is mechanically joined with the first screen portion such that the first conduit section and the second conduit section form a flow path. A valve member is arranged in the flow path. The valve member includes a a first end segment, a second end segment and an inner surface defining a conduit. First end segment is arranged in the first conduit section without a mechanical connection and the second end segment is arranged in the second conduit section without a mechanical connection. A valve element is slideably arranged in the conduit.

20 Claims, 5 Drawing Sheets

SCREEN AND VALVE SYSTEM

BACKGROUND

In the resource recovery industry boreholes are formed in a formation for the purpose of stimulating and or producing formation fluids. A tubular may be positioned in the wellbore to guide fluids to a surface of the formation. The tubular may include one or more openings that permit formation fluids to enter and flow toward the surface. In many cases, a screen will be positioned over the one or more openings in order to prevent or at least limit debris from passing into the tubular with the formation fluid.

Often times, a valve is arranged in the tubular at the one or more openings. The valve may control access for the formation fluid entering the tubular. The valve, tubular, and screen are formed off-site, transported to a well site, and run into the borehole. Constructing a valve and screen assembly is a time consuming endeavor that requires forming threads, installing the valve in a tubular, making up multiple connections, and constructing a screen about the tubular. Given the cost and complexity of forming a screen and valve assembly, the industry would welcome simpler, more cost effective and easily repairable systems.

SUMMARY

Disclosed is a screen and valve system including a first screen portion including a first end, a second end, and a first wall having an inner surface and an outer surface. The inner surface defines a first conduit section. A first screen segment is arranged over the outer surface of the first screen portion. A second screen portion includes a first end section, a second end section, and a second wall including an inner surface portion and an outer surface portion. The inner surface portion defines a second conduit section. The second screen portion is mechanically joined with the first screen portion such that the first conduit section and the second conduit section form a flow path. A second screen segment arranged over the outer surface of the second screen portion. A valve member is arranged in the flow path. The valve member includes a body having a first end segment, a second end segment, an outer surface, an inner surface, and at least one opening extending between the outer surface and the inner surface. The inner surface defining a conduit. First end segment is arranged in the first conduit section without a mechanical connection and the second end segment is arranged in the second conduit section without a mechanical connection. A valve element is slideably arranged in the conduit.

Also disclosed is a resource exploration and recovery system including a first system and a second system including a tubular string fluidically connected to the first system. The tubular string supports a screen and valve system including a first screen portion including a first end, a second end, and a first wall having an inner surface and an outer surface. The inner surface defines a first conduit section. A first screen segment is arranged over the outer surface of the first screen portion. A second screen portion includes a first end section, a second end section, and a second wall including an inner surface portion and an outer surface portion. The inner surface portion defines a second conduit section. The second screen portion is mechanically joined with the first screen portion such that the first conduit section and the second conduit section form a flow path. A second screen segment arranged over the outer surface of the second screen portion. A valve member is arranged in the flow path. The valve member includes a body having a first end segment, a second end segment, an outer surface, an inner surface, and at least one opening extending between the outer surface and the inner surface. The inner surface defining a conduit. First end segment is arranged in the first conduit section without a mechanical connection and the second end segment is arranged in the second conduit section without a mechanical connection. A valve element is slideably arranged in the conduit.)

Still further disclosed is a method of forming a screen and valve system includes installing a first portion of a valve member including a selectively shiftable valve element into a first screen portion, covering a second portion of the valve member with a second screen portion, and connecting the first screen portion to the second screen portion.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
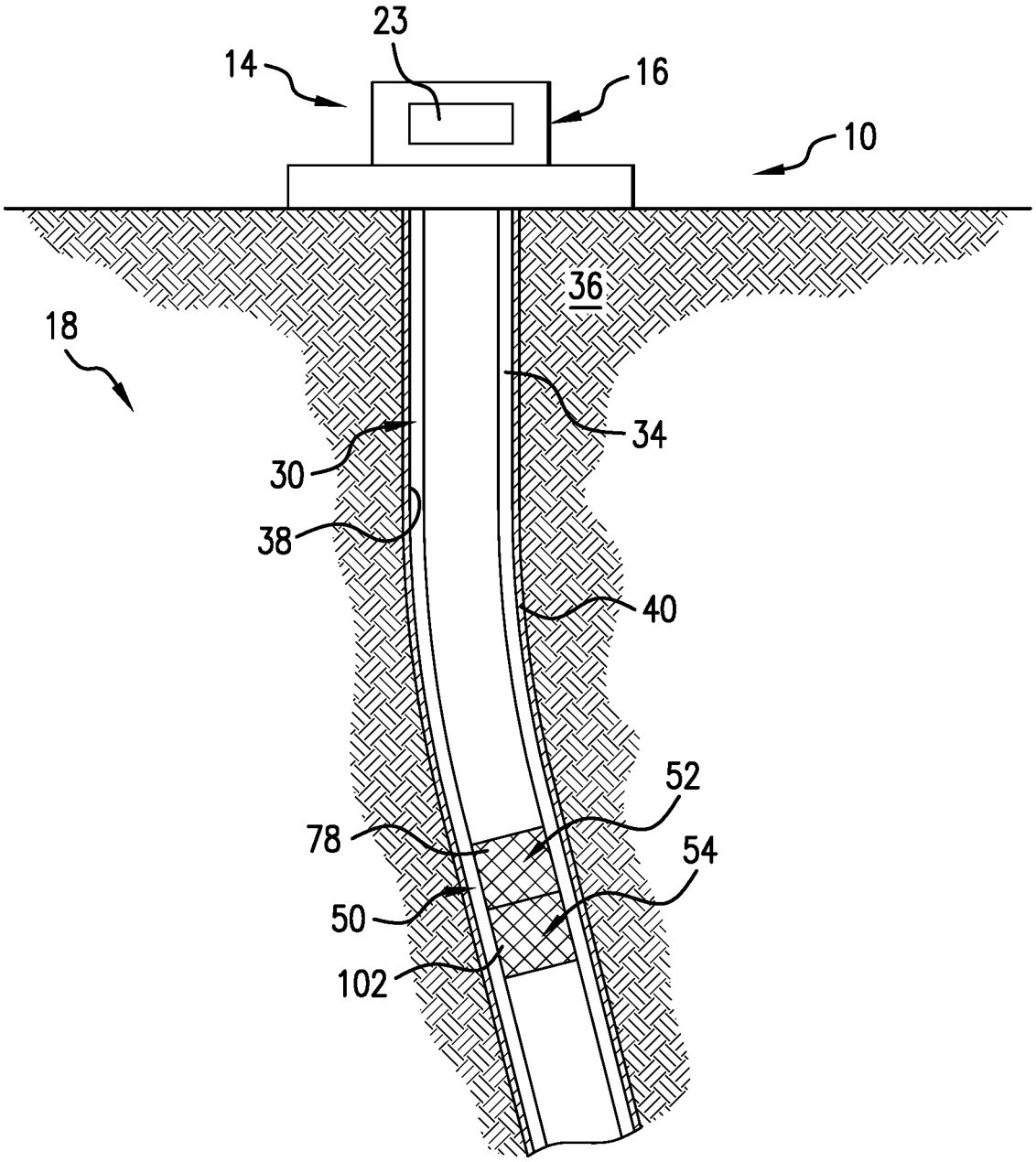
FIG. 1 is an example of a system for performing downhole operations including a screen and valve system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Tubular string 30 may take the form of a plurality of interconnected tubulars, coil tubing, or the like. Wellbore 34 includes an annular wall 38 which may be defined by a casing tubular 40. Of course, annular wall 38 could be defined by a surface of formation 36.

Figure 2:
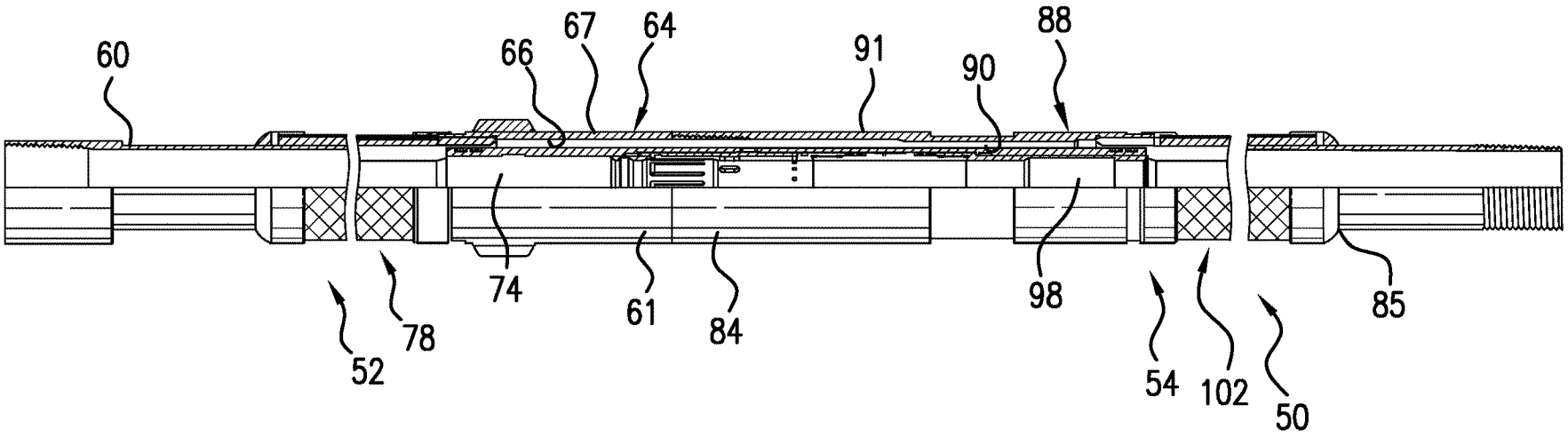
FIG. 2 depicts a plan view of the screen and valve system of FIG. 1.
Figure 3:
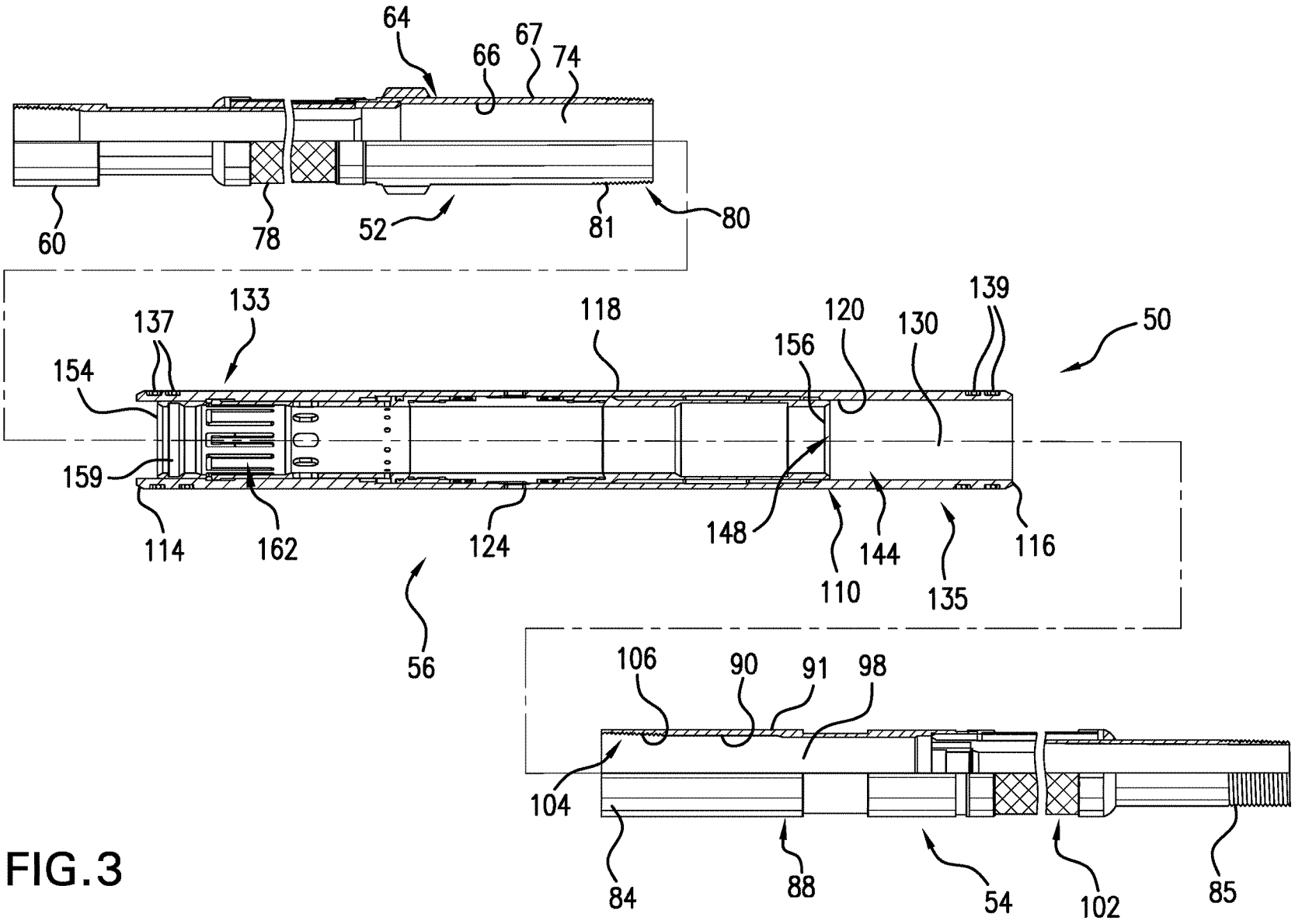
FIG. 3 depicts a dissembled view of the screen and valve system of FIG. 2.

In accordance with an exemplary embodiment, tubular string 30 supports a valve and screen system 50. Referring to FIGS. 2 and 3, valve and screen system 50 includes a first screen portion 52 coupled to a second screen portion 54. A valve member 56 (FIG. 3) is arranged internally of first and second screen portions 52 and 54. First screen portion 52 includes a first end 60, a second end 61 and a first wall 64 extending therebetween. First wall 64 includes an inner surface 66 and an outer surface 67. Inner surface 66 defines a first conduit section 74 that is receptive of a first portion (not separately labeled) of valve member 56.

A first screen segment 78 is provided over first wall 64. First screen segment 78 may be formed separately from first screen portion 52 and installed on first wall 64. Alternatively, first screen segment 78 by be constructed directly onto first wall 64. First screen segment 78 filters formation fluids passing into first screen portion 52. First screen portion 52 also includes a first connector portion 80 (FIG. 3) at second end 61. First connector portion 80 may take the form of a pin end or externally threaded connector 81. Of course, it should be understood that first end 60 also includes a connector (not separately labeled) that interfaces with tubular string 30.

Second screen portion 54 includes a first end section 84, a second end section 85 and a second wall 88 extending therebetween. Second wall 88 includes an inner surface portion 90 and an outer surface portion 91. Inner surface portion 90 defines a second conduit section 98 that is receptive of a second portion (not separately labeled) of valve member 56. A second screen segment 102 is provided over second wall 88. Second screen segment 102 may be formed separately from second screen portion 54 and installed on second wall 88. Alternatively, second screen segment 102 by be constructed directly onto second wall 88. Second screen segment 102 filters formation fluids passing into second screen portion 54.

Referring to FIG. 3, second screen portion 54 also includes a second connector portion 104 at first end portion 84. Second connector portion 104 may take the form of a box end or internally threaded connector 106. Of course, it should be understood that second end portion 85 also includes a connector (not separately labeled) that interfaces with tubular string 30.

In accordance with an exemplary aspect, valve member 56 includes a body 110 having a first end segment 114, and a second end segment 116. Body 110 includes an outer surface 118 extends between first end segment 114 and second end segment 116. Body 110 also includes an inner surface 120 that extends between first end segment 114 and 116. At least one opening 124 extends through outer surface 118 and inner surface 120. Inner surface 120 defines a conduit 130.

A first seal 133 is arranged on outer surface 118 at first end segment 114 and a second seal 135 is arranged on outer surface 118 at second end segment 116. First seal 133 may take the form of a first pair of seals 137 and second seal 135 may take the form of a second pair of seals 139. First seal 133 abuts inner surface 66 of first screen portion 52 and second seal 135 abuts inner surface portion 90 of second screen portion 54. Outer surface 118 is spaced from inner surface 66 of first screen portion 52 and inner surface portion 90 of second screen portion 54. A flow passage (not separately labeled) is defined radially between outer surface 118 and inner surface 66 and inner surface portion 90, and axially between first and second seals 133 and 135.

A valve element 144 is slidably arranged in conduit 130. Valve element 144 includes a body element 148 having a first end portion 154 and a second end portion 156. First end portion 154 may include a valve seat 159. Body element 148 also includes plurality of openings 162 that may selectively register with at least one opening 124. Valve seat 159 may be responsive to, for example, a drop ball (not shown). The drop ball or other device may be employed to shift valve element 144 to open and close a flow path by aligning plurality of openings 162 with at least one opening 124 thereby allowing formation fluids to pass into tubular string 30 and flow toward surface system 16.

Valve member 56 is arranged in first conduit section 74 and second conduit section 98. Valve member 56 may be held in place by a compressive force that is generated by engaging first connector portion 80 and second connector portion 104 when joining first screen portion 52 and second screen portion 54. It should be understood that valve member 54 is devoid of any connectors. That is, neither first end segment 114 nor second end segment 116 includes a connector that interfaces with first screen portion 52 and second screen portion 54. It should also be understood that the compressive force is generated during installation. Given the presence of casing tubular 40, no compressive, tensile, or torsional forces are seen by valve member 56 after installation. With this arrangement, screen and valve system 50 may be constructed on site. Further, screen and valve system 50 may be readily repaired in the field. Thus, the present invention reduces manufacturing costs, delivery costs, and maintenance costs of the screen assembly.

Figure 4:
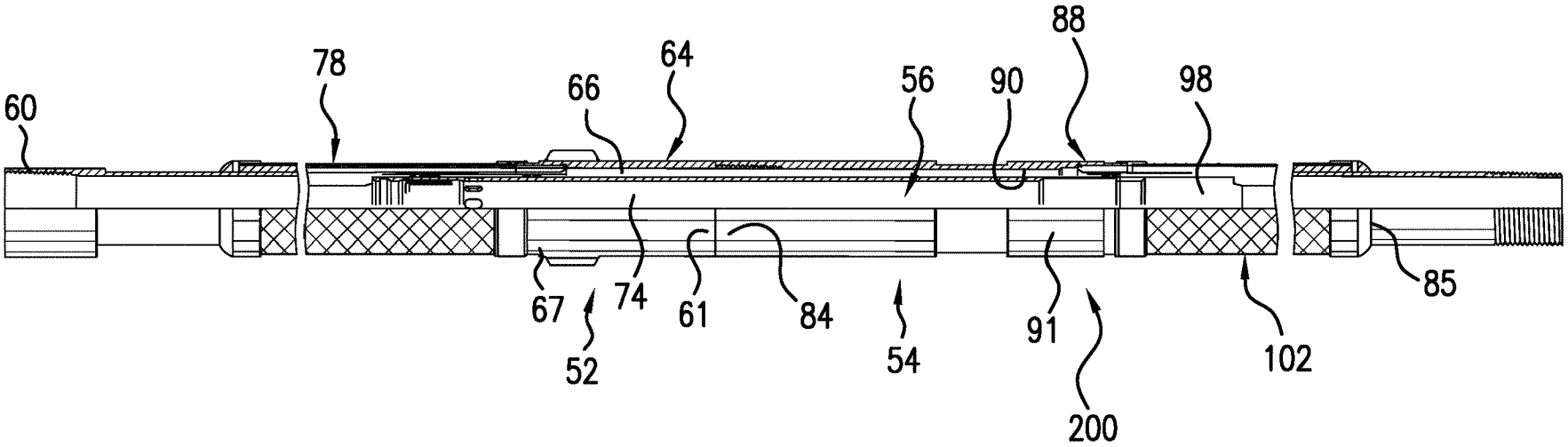
FIG. 4 depicts a plan view of the screen and valve system of FIG. 1, in accordance with another aspect of an exemplary embodiment.
Figure 5:
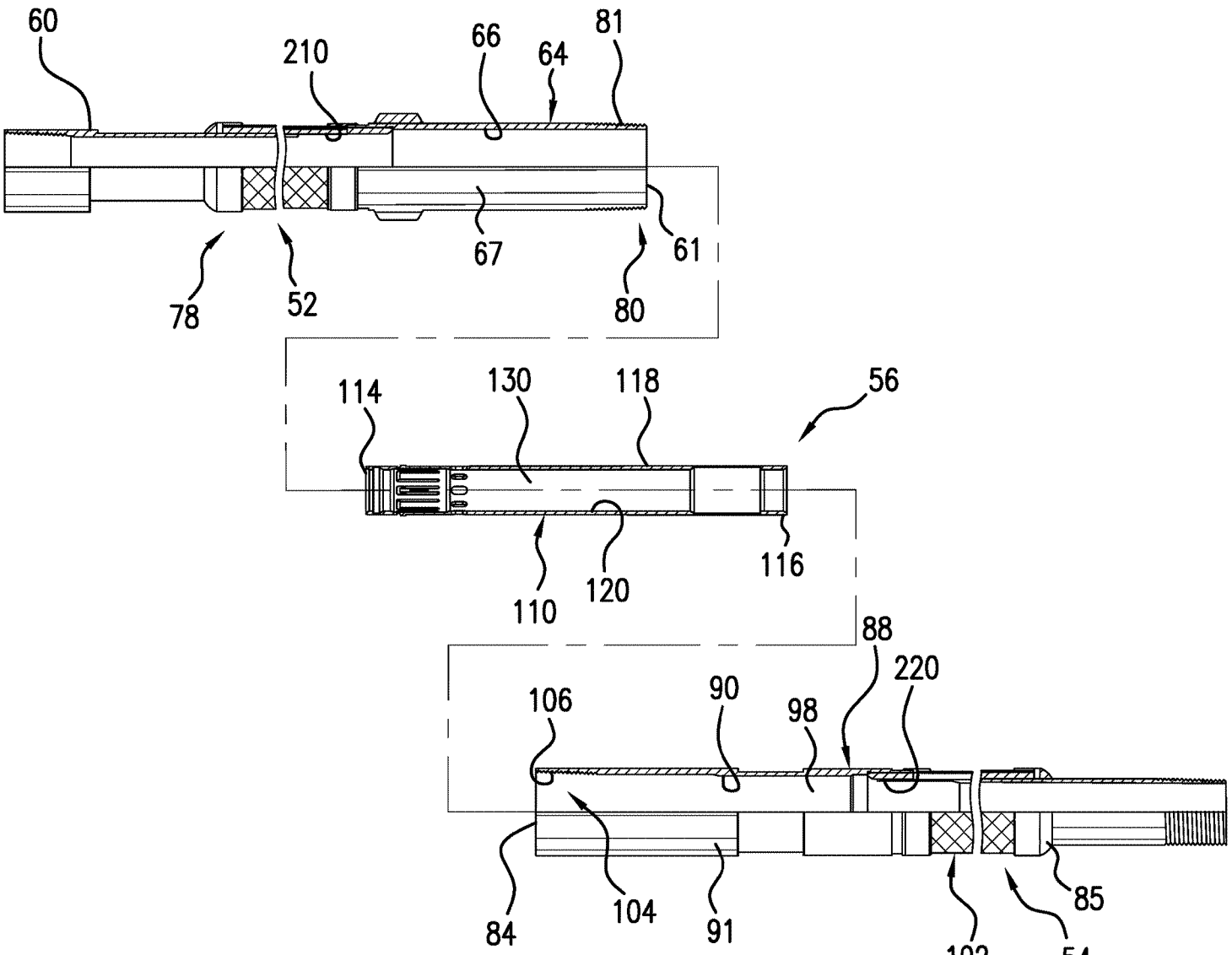
FIG. 5 depicts a dissembled view of the screen and valve system of FIG. 4.

Reference will now follow to FIGS. 4 and 5, wherein like reference numbers represent corresponding parts in the respective views, in describing a valve and screen system 200 in accordance with another aspect of an exemplary embodiment. Valve and screen system 200 includes a first seal 210 arranged on inner surface 66 of first screen portion 52. First seal 210 is positioned in inner surface 66 adjacent to first screen segment 78. A second seal 220 is arranged on inner surface 90 of second screen portion 54. Second seal 220 is arranged on inner surface 90 adjacent to second screen segment 102. With this arrangement, there is no need for a separate valve element within conduit 130 of valve member 56. That is, valve member 56 serves as the valve element in accordance with an aspect of an exemplary embodiment.

Set forth below are some embodiments of the foregoing disclosure:

Embodiment 1. A screen and valve system comprising: a first screen portion including a first end, a second end, and a first wall having an inner surface and an outer surface, the inner surface defining a first conduit section; a first screen segment arranged over the outer surface of the first screen portion; a second screen portion including a first end section, a second end section, and a second wall including an inner surface portion and an outer surface portion, the inner surface portion defining a second conduit section, the second screen portion being mechanically joined with the first screen portion such that the first conduit section and the second conduit section form a flow path; a second screen segment arranged over the outer surface of the second screen portion; a valve member arranged in the flow path, the valve member including a body having a first end segment, a second end segment, an outer surface, an inner surface, and at least one opening extending between the outer surface and the inner surface, the inner surface defining a conduit, wherein the first end segment is arranged in the first conduit section without a mechanical connection and the second end segment is arranged in the second conduit section without a mechanical connection; and a valve element slideably arranged in the conduit.

Embodiment 2. The screen and valve system according to any prior embodiment, further comprising: a first seal arranged on the first end segment, the first seal abutting the inner surface of the first wall.

Embodiment 3. The screen and valve system according to any prior embodiment, wherein the first seal comprises a first pair of seals arranged on the outer surface at the first end segment.

Embodiment 4. The screen and valve system according to any prior embodiment, further comprising: a second seal arranged on the second end segment, the second seal abutting the inner surface portion of the second wall.

Embodiment 5. The screen and valve system according to any prior embodiment, wherein the second seal comprises a second pair of seals arranged on the outer surface at the second end segment.

Embodiment 6. The screen and valve system according to any prior embodiment, further comprising: a first seal arranged on the inner surface of the first screen portion, the first seal being configured to abut the first end segment of the valve member.

Embodiment 7. The screen and valve system according to any prior embodiment, further comprising: a second seal arranged on the inner surface portion of the second screen portion, the second seal being configured to abut the second end segment of the valve member.

Embodiment 8. The screen and valve system according to any prior embodiment, wherein the first seal includes two adjacent seals and the second seal includes two adjacent seals.

Embodiment 9. The screen and valve system according to any prior embodiment, wherein the second end segment includes a first connector portion.

Embodiment 10. The screen and valve system according to any prior embodiment, wherein during installation the first and second screen portions apply a compressive force to the valve member.

Embodiment 11. The screen and valve system according to any prior embodiment, wherein the valve element includes one or more openings that selectively align with the at least one opening of the valve member.

Embodiment 12. A resource exploration and recovery system comprising: a first system; a second system including a tubular string fluidically connected to the first system, the tubular string supporting a screen and valve system comprising: a first screen portion including a first end, a second end, and a first wall having an inner surface and an outer surface, the inner surface defining a first conduit section; a first screen segment arranged over the outer surface of the first screen portion; a second screen portion including a first end section, a second end section, and a second wall including an inner surface portion and an outer surface portion, the inner surface portion defining a second conduit section, the second screen portion being mechanically joined with the first screen portion such that the first conduit section and the second conduit section form a flow path; a second screen segment arranged over the outer surface of the second screen portion; a valve member arranged in the flow path, the valve member including a body having a first end segment, a second end segment, an outer surface, an inner surface, and at least one opening extending between the outer surface and the inner surface, the inner surface defining a conduit, wherein the first end segment is arranged in the first conduit section without a mechanical connection and the second end segment is arranged in the second conduit section without a mechanical connection; and a valve element slideably arranged in the conduit.

Embodiment 13. The resource exploration and recovery system according to any prior embodiment, further comprising: a first seal arranged on the first end segment, the first seal abutting the inner surface of the first wall.

Embodiment 14. The resource exploration and recovery system according to any prior embodiment, further comprising: a second seal arranged on the second end segment, the second seal abutting the inner surface portion of the second wall.

Embodiment 15. The resource exploration and recovery system according to any prior embodiment, wherein the first seal comprises a first pair of seals arranged on the outer surface at the first end segment and the second seal comprises a second pair of seals arranged on the outer surface at the second end segment.

Embodiment 16. The resource exploration and recovery system according to any prior embodiment, further comprising: a first seal arranged on the inner surface of the first screen portion, the first seal being configured to abut the first end segment of the valve member.

Embodiment 17. The resource exploration and recovery system according to any prior embodiment, further comprising: a second seal arranged on the inner surface portion of the second screen portion, the second seal being configured to abut the second end segment of the valve member.

Embodiment 18. The resource exploration and recovery system according to any prior embodiment, wherein the first seal includes two adjacent seals and the second seal includes two adjacent seals.

Embodiment 19. A method of forming a screen and valve system comprising: installing a first portion of a valve member including a selectively shiftable valve element into a first screen portion; covering a second portion of the valve member with a second screen portion; and connecting the first screen portion to the second screen portion.

Embodiment 20. The method according to any prior embodiment, wherein connecting the first screen portion to the second screen portion includes compressing the valve member between the first and second screen portions.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A screen and valve system comprising:

a first screen portion including a first end, a second end, and a first wall having an inner surface and an outer surface, the inner surface defining a first conduit section;

a first screen segment arranged over the outer surface of the first screen portion;

a second screen portion including a first end section, a second end section, and a second wall including an inner surface portion and an outer surface portion, the inner surface portion defining a second conduit section, the second screen portion being mechanically joined with the first screen portion such that the first conduit section and the second conduit section form a flow path;

a second screen segment arranged over the outer surface of the second screen portion;

a valve member fixedly arranged in the flow path, the valve member including a body having a first end segment abutting the first screen segment, a second end segment abutting the second screen segment, an outer surface, an inner surface, and at least one opening extending between the outer surface and the inner surface, the inner surface defining a conduit, wherein the first end segment is arranged in the first conduit section without a mechanical connection and the second end segment is arranged in the second conduit section without a mechanical connection; and a valve element slideably arranged in the conduit.

2. The screen and valve system according to claim 1, further comprising: a first seal arranged on the first end segment, the first seal abutting the inner surface of the first wall.

3. The screen and valve system according to claim 2, wherein the first seal comprises a first pair of seals arranged on the outer surface at the first end segment.

4. The screen and valve system according to claim 2, further comprising: a second seal arranged on the second end segment, the second seal abutting the inner surface portion of the second wall.

5. The screen and valve system according to claim 4, wherein the second seal comprises a second pair of seals arranged on the outer surface at the second end segment.

6. The screen and valve system according to claim 1, further comprising: a first seal arranged on the outer surface of the first end segment of the valve member, the first seal being configured to abut the inner surface of the first screen portion.

7. The screen and valve system according to claim 6, further comprising: a second seal arranged on the outer surface of the second end segment of the valve member, the second seal being configured to abut the inner surface portion of the second screen portion.

8. The screen and valve system of claim 7, wherein the first seal includes two adjacent seals and the second seal includes two adjacent seals.

9. The screen and valve system according to claim 1, wherein the second screen portion includes a second connector portion.

10. The screen and valve system according to claim 1, wherein during installation the first and second screen portions apply a compressive force to the valve member.

11. The screen and valve system according to claim 1, wherein the valve element includes one or more openings that selectively align with the at least one opening of the valve member.

12. A resource exploration and recovery system comprising:

a first system;

a second system including a tubular string fluidically connected to the first system, the tubular string supporting a screen and valve system comprising:

a first screen portion including a first end, a second end, and a first wall having an inner surface and an outer surface, the inner surface defining a first conduit section;

a first screen segment arranged over the outer surface of the first screen portion;

a second screen portion including a first end section, a second end section, and a second wall including an inner surface portion and an outer surface portion, the inner surface portion defining a second conduit section, the second screen portion being mechanically joined with the first screen portion such that the first conduit section and the second conduit section form a flow path;

a second screen segment arranged over the outer surface of the second screen portion;

a valve member fixedly arranged in the flow path, the valve member including a body having a first end segment abutting the first screen segment, a second end segment abutting the second screen segment, an outer surface, an inner surface, and at least one opening extending between the outer surface and the inner surface, the inner surface defining a conduit, wherein the first end segment is arranged in the first conduit section without a mechanical connection and the second end segment is arranged in the second conduit section without a mechanical connection; and a valve element slideably arranged in the conduit.

13. The resource exploration and recovery system according to claim 12, further comprising: a first seal arranged on the first end segment, the first seal abutting the inner surface of the first wall.

14. The resource exploration and recovery system according to claim 13, further comprising: a second seal arranged on the second end segment, the second seal abutting the inner surface portion of the second wall.

15. The resource exploration and recovery system according to claim 14, wherein the first seal comprises a first pair of seals arranged on the outer surface at the first end segment and the second seal comprises a second pair of seals arranged on the outer surface at the second end segment.

16. The resource exploration and recovery system according to claim 12, further comprising: a first seal arranged on the outer surface of the first end segment of the valve member, the first seal being configured to abut the inner surface of the first screen portion.

17. The resource exploration and recovery system according to claim 16, further comprising: a second seal arranged on the outer surface of the second end segment of the valve member, the second seal being configured to abut the inner surface portion of the second screen portion.

18. The resource exploration and recovery system of claim 17, wherein the first seal includes two adjacent seals and the second seal includes two adjacent seals.

19. A method of forming a screen and valve system comprising:

installing a first portion of a valve member including a selectively shiftable valve element into a first screen portion;

covering a second portion of the valve member with a second screen portion; and connecting the first screen portion to the second screen portion to fixedly secure the valve member in the first and second screen portions.

20. The method of claim 19, wherein connecting the first screen portion to the second screen portion includes compressing the valve member between the first and second screen portions.

* * * * *